US005452802A

United States Patent [19]

Green

[11] Patent Number: 5,452,802

[45] Date of Patent: Sep. 26, 1995

[54] COMPOSITE PAPERBOARD AND SHRINK FILM VISUAL MERCHANDISING PACKAGE

[75] Inventor: Andrew G. Green, Ridgefield, Conn.

[73] Assignee: Rexham Corporation, Charlotte, N.C.

[21] Appl. No.: 144,832

[22] Filed: Oct. 29, 1993

[51] Int. Cl.[6] ..... B65D 73/00

[52] U.S. Cl. ..... 206/466; 206/461; 206/497

[58] Field of Search ..... 206/45.33, 461, 206/466, 471, 497, 806

[56] References Cited

U.S. PATENT DOCUMENTS

| | | | |
|---|---|---|---|
| 2,463,992 | 3/1949 | Moore | 206/466 |
| 3,298,515 | 1/1967 | Watts, Jr. | 206/471 |
| 3,334,804 | 8/1967 | Watts, Jr. | 206/466 |
| 3,370,733 | 2/1968 | Giesler | 206/497 |
| 3,912,079 | 10/1975 | Selchow, Jr. | 206/497 |
| 4,053,050 | 10/1977 | Forbes, Jr. et al. | 206/806 |

*Primary Examiner*—David T. Fidei

*Attorney, Agent, or Firm*—Schweitzer Cornman & Gross

[57] ABSTRACT

A unit display package assembly for packaging articles for hanging from display hooks or for free-standing display comprises a foldable paperboard blank having a flat heat shrinkable film adhered thereto, said paperboard blank being cut, scored, and folded to define a central header portion having contiguous first and second header wings articulated thereto; film support legs depending from each of said first and second header wings; lower edges of said central header and said wings and the inner side edges of said support legs defining an elongated U-shaped opening of predetermined width; said heat shrinkable film being adhered to said support legs and bridging said opening; a glue lap articulated to said first support leg and folded over one edge of said film to sandwich the film therebetween; said header wings being adapted to be folded into juxtaposition with said central header portion while said glue lap is folded into juxtaposition with said second support leg to form a three layer header having a depending multi-layer central spine and simultaneously forming a closed cylindrical heat shrinkable sleeve projecting outwardly from said central spine.

6 Claims, 5 Drawing Sheets

COMPOSITE PAPERBOARD AND SHRINK FILM VISUAL MERCHANDISING PACKAGE

BACKGROUND OF THE INVENTION

The present invention relates to improvements in carded merchandise packages in which merchandise may be hung with enhanced visibility from pegs on display racks. More particularly, it is directed to improvements in display packages of this general type in which adequate space for displaying product information and UPC codes is provided while using minimum amounts of paperboard and shrink film packaging materials. The new packages require less display space on display racks, as well as providing a package which will enable the product to be vended and/or displayed by suspension from hooks or pegs or by display in gravity feed racks where the base of the article in the package provides the requisite support.

Carded merchandise packaging comprising a paperboard header and a preformed heat shrinkable plastic sleeve made from seamed (welded) or seamless tubing is well known to the art. Representative examples of such packages are shown in U.S. Pat. Nos. 4,166,532 Tsuchida et al.; 4,555,025 Weinberg et al.; 5,020,669 Nakagoshi; 4,981,213 Dillon; 3,881,601 Walus et al.; 3,540,583 Tomlinson; 3,424,306 Munck; 3,891,090 Spiegel et al.; 3,885,667 Spiegel et al.; 3,885,671 Spiegel et al.; and 3,764,002 Spiegel et al.

The present invention is directed to new packages which overcome certain deficiencies in the prior art structures in terms of ease of manufacture, ease of display, economies of materials, and the universality of the package, i.e. one which may be displayed and vended on hanging racks as well as being adapted for display in sliding gravity racks.

SUMMARY OF THE INVENTION

In accordance with the principles of the present invention, a new and improved package is provided for merchandise to be displayed and sold on hanging racks or gravity feed racks, which package is formed from a paperboard blank which is cut, scored, and folded to provide a hanging header and a support spine for a heat shrinkable sleeve through which the displayed product is united with the header. In accordance with an important aspect of the present invention, the heat shrinkable sleeve is formed in situ from a flat film adhered to the flat paperboard blank when the blank is folded.

The resultant shrink package enables retailers to use one type of packaging for the same product to vend that product in either hanging racks or gravity feed racks in a multiplicity of store locations. This results in a reduction of inventory of both packages and product. Of equal importance, the configuration of the new package is streamlined so as to enable more products to be displayed side by side than heretofore has been the case with conventional carded "blister packages". In addition the package construction lends itself to use with varieties of shapes and sizes of product without custom tooling as would be the case were rigid plastic "blisters" to be employed.

DESCRIPTION OF THE DRAWINGS

The advantages to be derived from the practice of the present invention may be better understood by referring to the accompanying drawings taken in conjunction with the following detailed description. In the drawings.

DETAILED DESCRIPTION OF THE INVENTION

Figure 1:
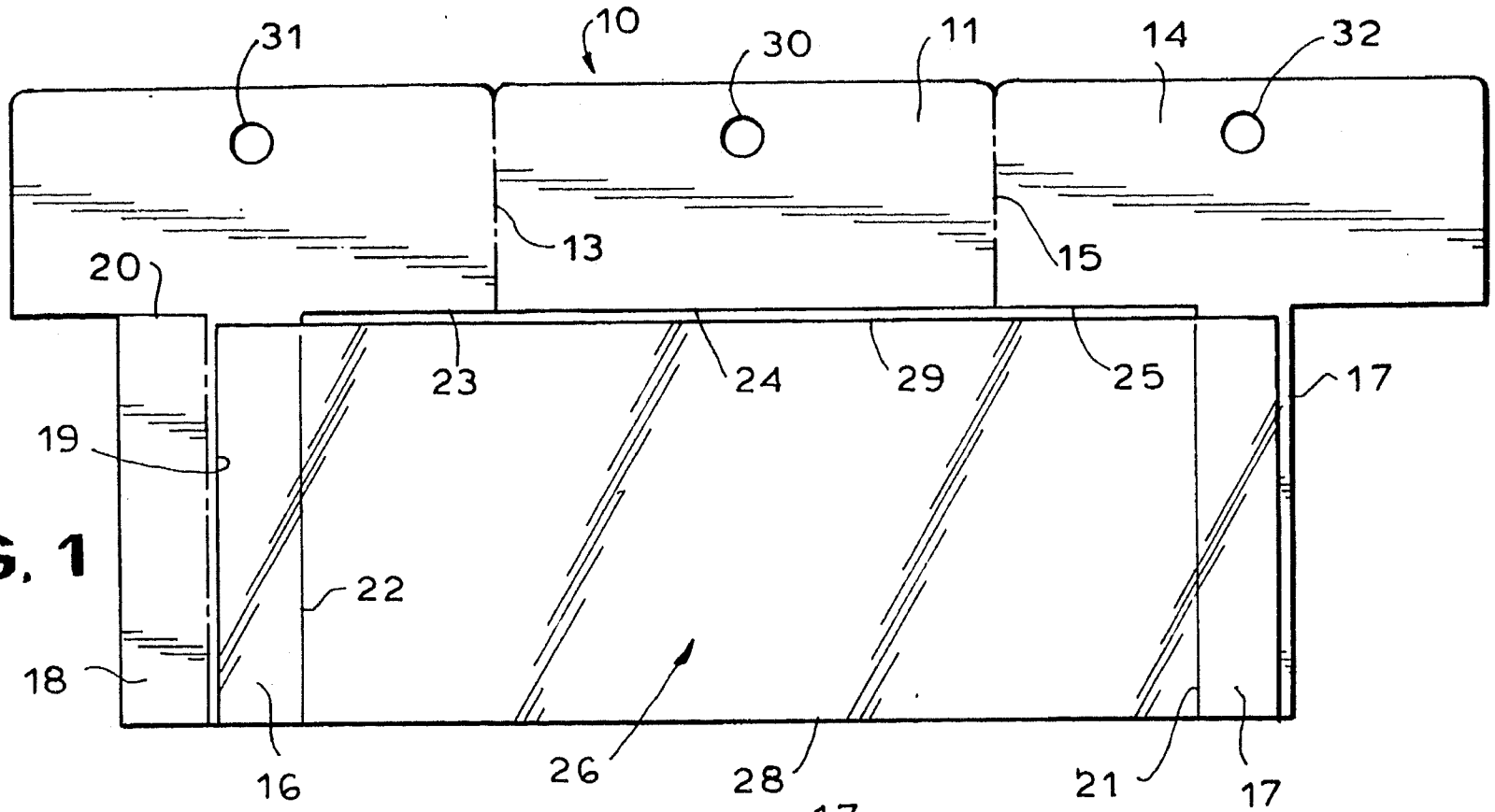
FIG. 1 is a plan view of the back side of a paperboard blank from which the package of the present invention may be formed with a rectangular sheet of heat shrinkable PVC film adhered thereto.

Referring now to FIG. 1, a new and improved composite paperboard and shrink film visual merchandising package in accordance with the principles of the invention is constructed from a paperboard blank 10 (the back side of which is shown in FIG. 1) which is cut and scored to form a central header panel 11 to which a first header wing panel 12 is articulated along a vertical score line 13 (formed by a cut on the front or printed side of the blank) and to which a second header wing panel 14 is articulated along a score line 15 parallel to the score line 13. Depending integrally from the header wing panels 12 and 14 are vertical leg members 16 and 17 respectively. Articulated to the outer edge of leg 16 along a vertical score line 19 is a glue lap 18 which is separated from the header wing panel 12 by a cut 20. The inner edges 21, 22 of the legs 1.6, 17 respectively, along with the lower edges 23, 24, and 25 of the panels 12, 11, and 14 respectively combine to define an elongated U-shaped opening 26 which is covered by a rectangular sheet of heat shrinkable polyvinylchloride (PVC) file 27 which is glued to the legs 16 and 17.

The bottom edges 28 of the film 27 is generally congruent with the lower edges of the legs 16 and 17, while the upper edge 29 of the PVC film 27 is spaced slightly below the edges 23, 24, 25 of the header panels.

Figure 2:
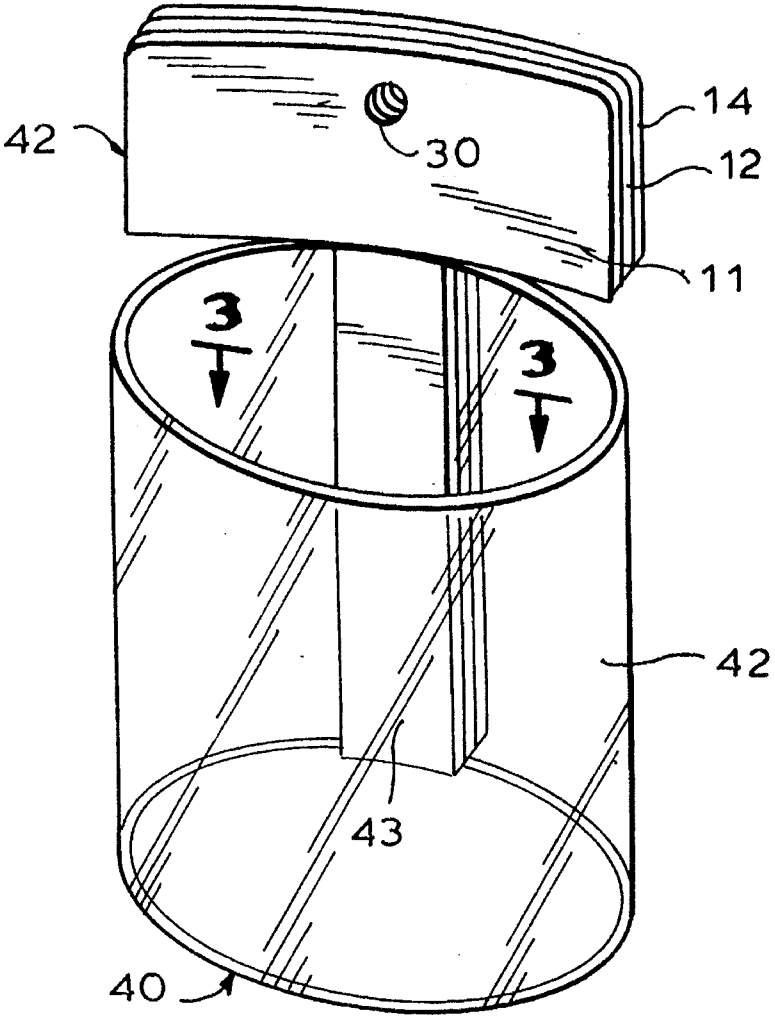
FIG. 2 is a perspective view of the new unit package formed from the blank of FIG. 1.

A central hanger hole 30 is formed in the center of header panel 11 while identical holes 31 and 32 are formed in the header wing panels 12 and 14 respectively. This completes the elements necessary to form a composite paperboard blank and heat shrinkable film unit which may be folded and glued in accordance with the principles of the present invention to form a composite new and improved visual merchandising package which is shown in FIG. 2. The front side of the blank will be printed with product information and UPC codes, as will be understood.

The new package of the invention is indicated in FIG. 2 by reference numeral 40 and it is formed by folding glue lap 18 over the film 27 which is adhered to the leg 16. Then, the wing 12 is folded along vertical score line 13 to place the wing panel 12 in juxtaposition with the header panel 11. Thereafter, the package 40 is completed by folding the wing 14 over the wing 12, bringing leg 17 with the adhered film 27 into superimposition with glue lap 18 to which it is then glued.

Figure 3:
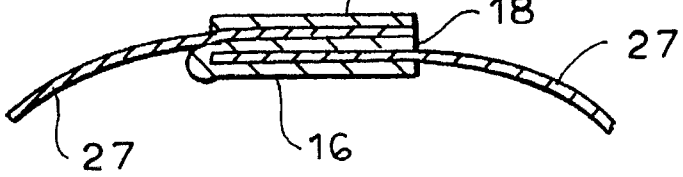
FIG. 3 is a cross-sectional view taken along line 3—3 of FIG. 2 showing details of construction and formation of the heat shrinkable sleeve of the present invention.

In accordance with an important aspect of the invention, the folding of the header panel wings 12 and 14 and the gluing of legs 17 and 18 results in the shaping and formation of the film 27 into a generally cylindrical sleeve 41 as shown in FIG. 2. The cylindrical sleeve 41 will be not only completed by the folding of the header panels 12 and 14 along the lines 13 and 15, but it will be reinforced and secured by the sandwiching of the ends of the PVC film 27 between the three plies 16, 17, and 18 of paperboard forming the legs 16 and 17 and the glue lap 18, as best shown in FIG. 3. Thus, the new composite packaging unit of FIG. 2 includes a three-ply header 42 having a depending three-ply leg or spine portion 43 in a general "T-shaped" configuration having a closed cylindrical sleeve 41 projecting forwardly therefrom. When the width of the "T" is greater than the product width, great product visibility is achieved and one size blank may be used for a variety of product sizes and shapes.

Figure 4:
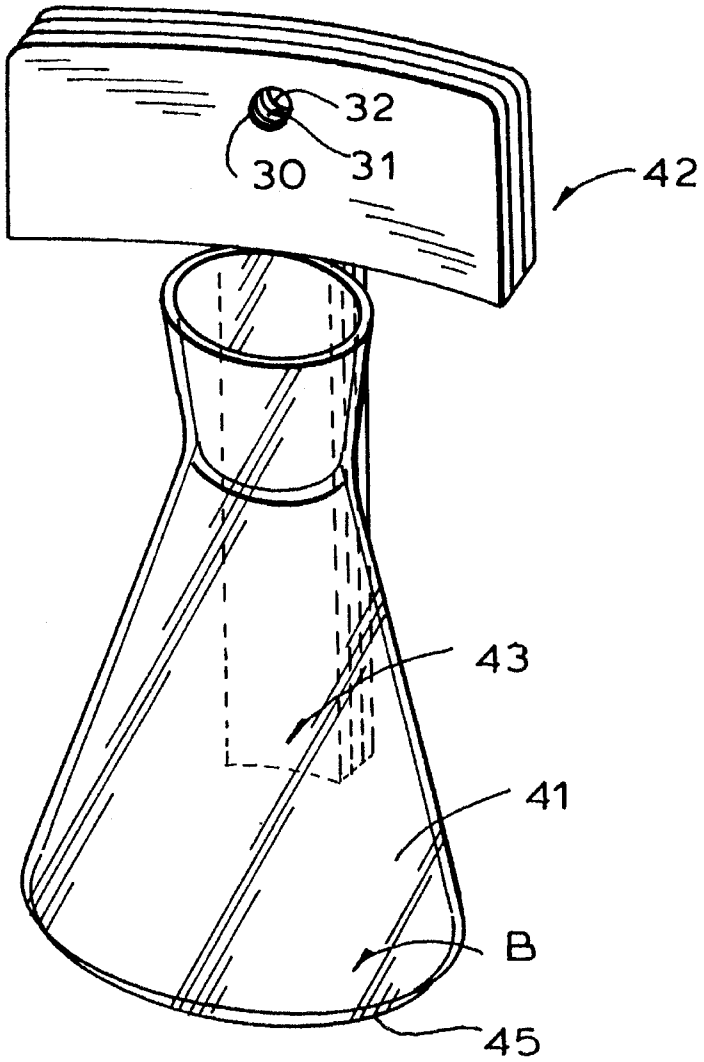
FIG. 4 is a perspective view of the package of FIG. 2 with an irregularly shaped object secured within the shrunken sleeve of the package.

The new unit will receive merchandise such as an irregularly shaped bottle B as shown in FIG. 4 and will encase and hold said bottle or other merchandise tightly and firmly against the spine 43 when the packaging unit 40 is subjected to heat. When the sleeve 41 shrinks tightly against the bottle, it will secure the bottle to the spine 43 as will be understood and as is illustrated in FIG. 4.

In accordance with the principles of the invention, the resulting package of FIG. 4 may be hung on a peg rack through the aperture formed by the juxtaposed hang holes 30, 31, and 32 in the header 42 or alternatively, the product may be displayed and supported by the base 45 of the packaged merchandise in a gravity feed rack. It will be noted that the width of the header 42 may be dimensioned so as to be equal to the width of the merchandise, thereby enabling the displayed articles to be hung on racks on centered pegs separated by the width of the product to be displayed. This leads to great efficiencies in display space as will be appreciated, as well as to great economies of materials used to provide the new packaging. It will be further appreciated that the resultant package may be vended by retailers in hanging racks, on pegs, or alternatively on gravity display racks since the package accommodates itself to either type of usage.

Figure 6:
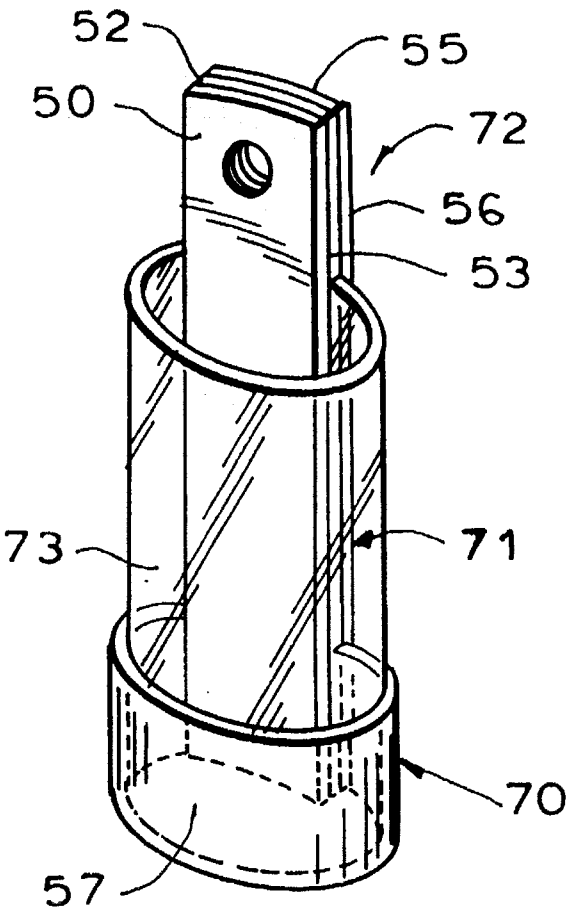
FIG. 6 is a perspective view of a packaging unit formed from the blank of FIG. 5.
Figure 5:
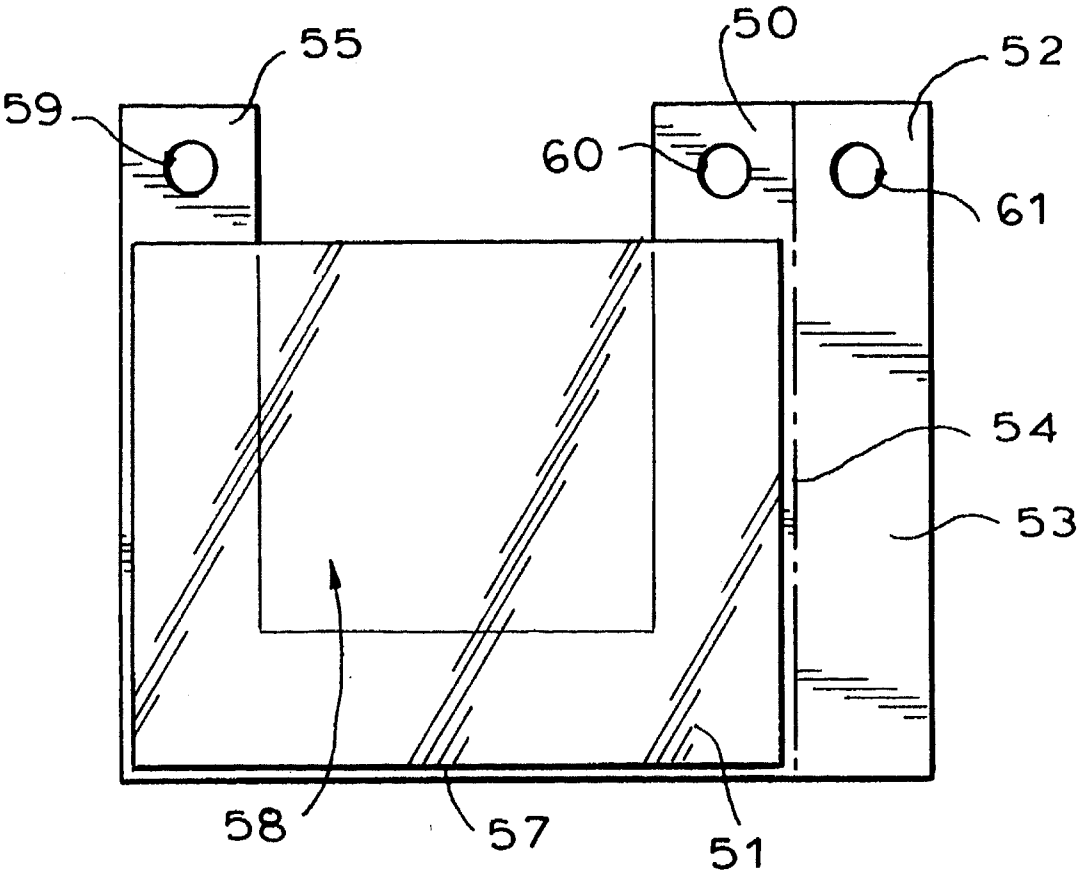
FIG. 5 is a plan view of the back side of an alternate package embodying the principles of the invention.

Shown in FIGS. 5 and 6 is an alternate form of the present invention, which is more streamlined and more economical in terms of using less paperboard, has a support spine and header which do not project to or beyond the periphery of the packaged goods. 6.

In the embodiment shown in FIG. 5, the composite package is formed from a blank having a first central header portion 50 which includes a depending support leg 51 of the same width as the header 50, to which central panel is articulated a first header wing 52 having an integral depending leg or spine portion 53. The elements 52, 53 are articulated to the elements 50, 51 along a vertical score line 54. Spaced from the header 50 is a second header wing panel 55 having a depending leg or spine portion 56 of equal width. The legs 51 and 56 are bridged by a lower bar portion 57 which combined with the legs 51 and 56 form a U-shaped opening 58. The opening 58 is covered by a heat shrinkable PVC film 59 adhered to the legs 51 and 56 and bar portion 57.

Hang holes 59, 60, and 61 are formed in the header panels 55, 50, 52 respectively, as shown in FIG. 5. The resultant composite paperboard blank and PVC film is folded into a new and improved composite display packaging unit 70 shown in FIG. 6 by first folding the header wing 52 and depending spine portion 53 over corresponding central header portion and central spine portion 51 to sandwich the PVC film 59 therebetween as will be understood.. Thereafter, the header portions 55, 56 are folded over the in-folded portions 52, 53 and are secured thereto by adhesive to trap the film 59 in the three-layer spine 71 formed by the juxtaposition of the elements 56, 51, and 53 and to form a three-layer header formed by the elements 50, 52, 55 as shown. As shown in FIG. 6, the central graphics display bar 57 when folded forms a tubular display surface on which graphics describing the product may be printed. When the product is placed in this unit, the sleeve 73 formed by the juxtaposition of the header elements 55, 50, 52 and the spine elements 51, 53, 56 will shrink tightly about a packaged object when subjected to heat, as will be understood.

Figure 7:
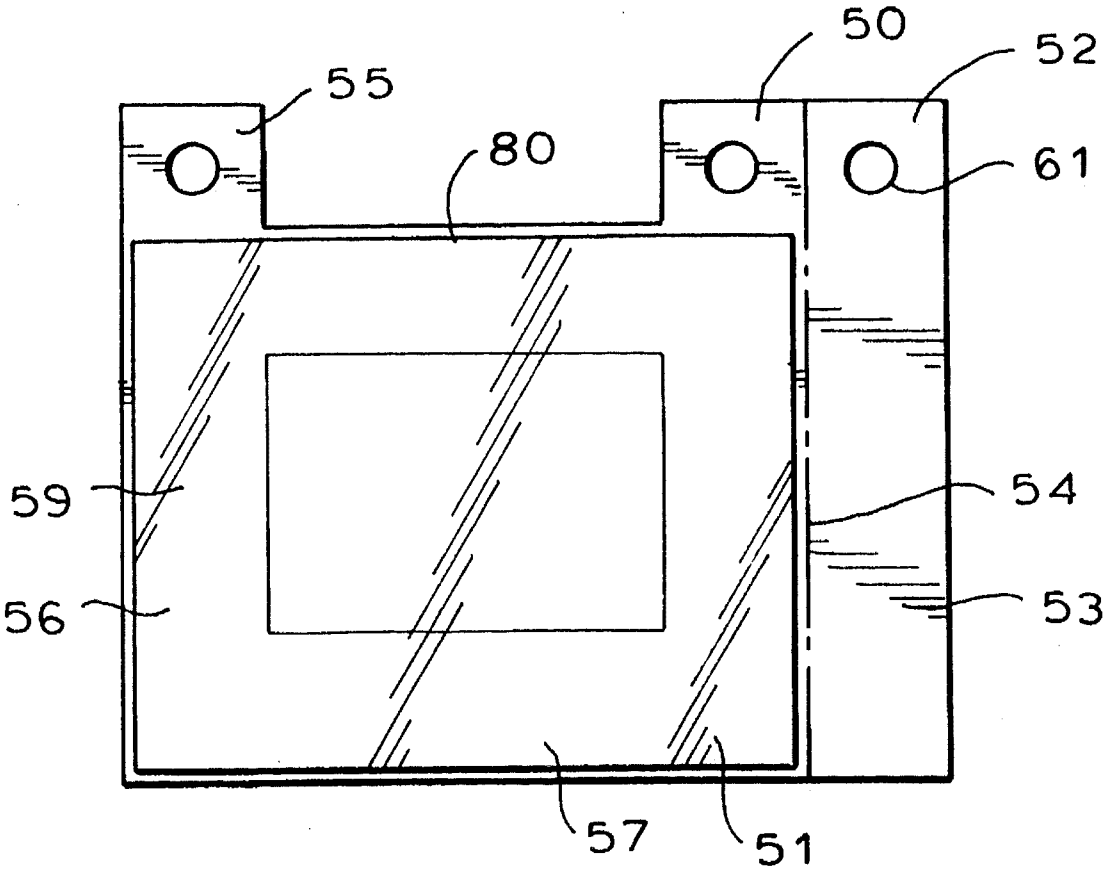
FIG. 7 is a plan view of the back side of a blank for a second alternative embodiment of the present invention.

An alternate embodiment to that shown in FIGS. 5 and 6 is similar in all respects thereto except that it includes an additional graphics display bar 80 which is parallel to the bar 57. In the FIGS. 7 and 8 embodiment, like reference numeral numerals have been employed for as those elements shown in FIGS. 5 and 6 which are the same. The resulting package shown in FIG. 8 is similar to that in FIG. 6 with the exception that there are two display bars 57 and 58 rather than a single display bar as in the embodiment of FIGS. 5 and 6.

Figure 10:
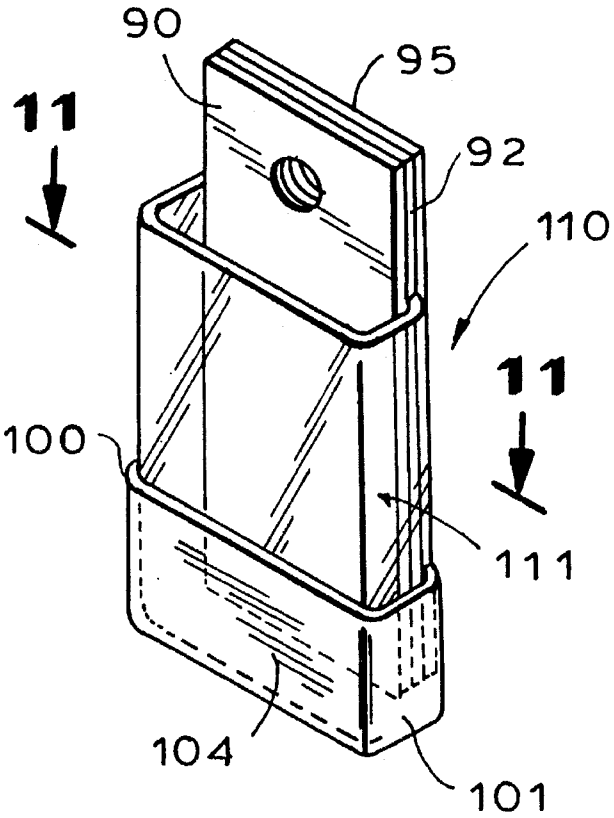
FIG. 10 is a perspective view of a package formed from the blank of FIG. 9.
Figure 9:
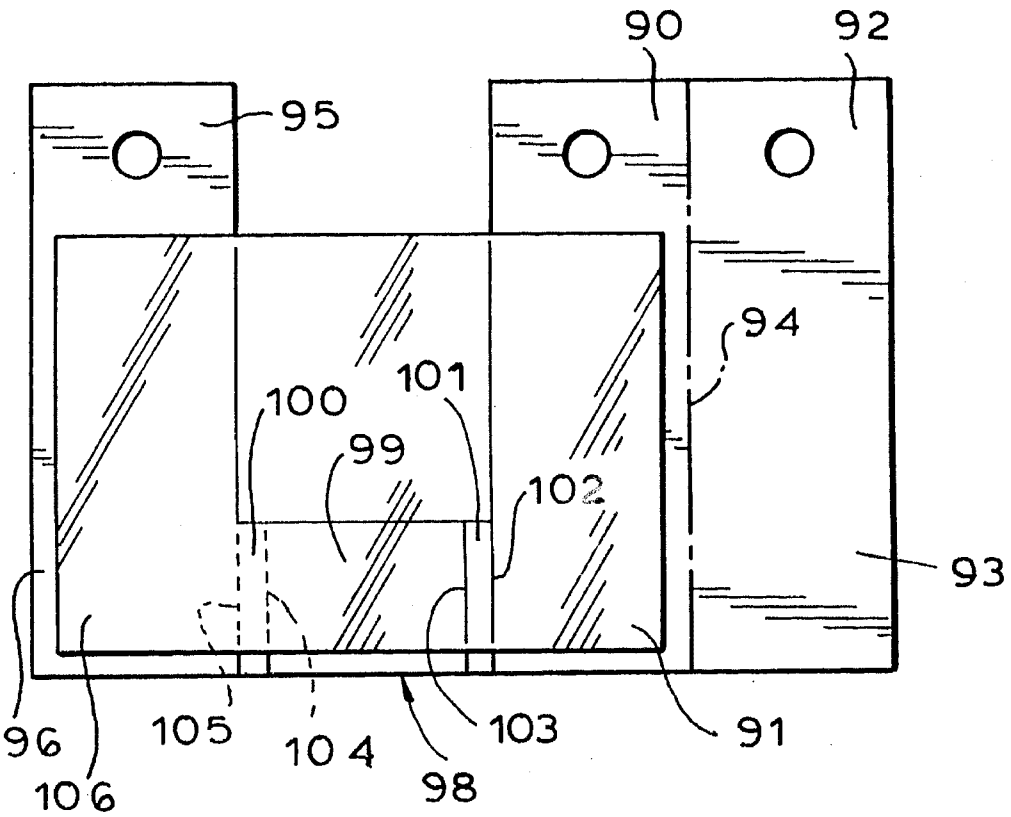
FIG. 9 is a plan view of the back side of another alternative form of a blank for practicing the invention.

A further alternate embodiment of the invention is shown in FIGS. 9 and 10 and it is especially well suited for use with products having a rectangular cross-section. In the embodiment of FIG. 9, a central header 90 having a depending spine portion 91 is articulated to a first header wing panel 92 having a depending leg or spine portion 93 along vertical score line 94. Spaced from the central header portion 90 is the second header wing panel 95 having a depending spine or leg portion 96 of equal width to the header portion. The spine or leg portions 91, 96 are bridged by a horizontal panel 98 divided into a front display portion 99 and two side wall portions 100 and 101 respectively. The panel 101 is articulated to the panel 91 along score line 102 and it is articulated to the front panel 99 along score line 103. Similarly, the side wall 100 is articulated to the front panel 99 along score line 104, while it is articulated to the leg 96 along score line 105. A film 106 of PVC is superimposed over the paperboard blank as shown.

Figure 8:
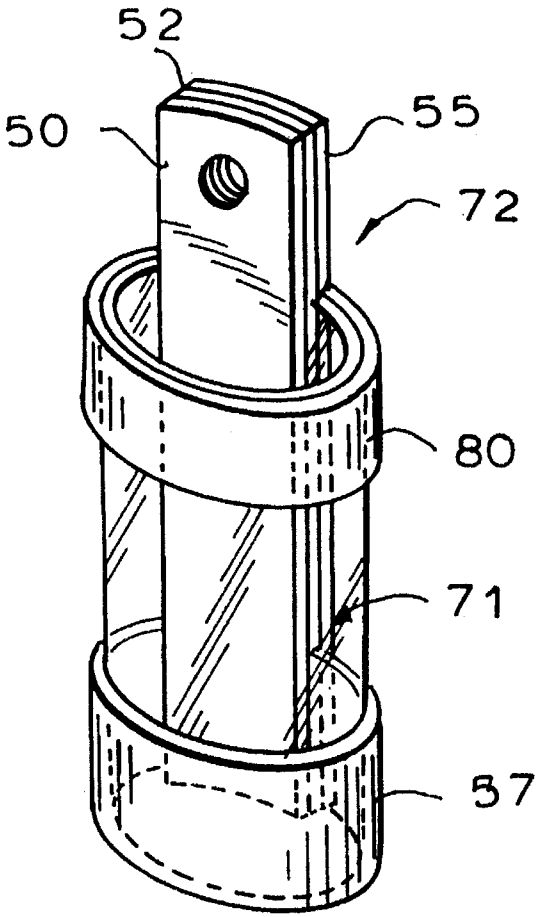
FIG. 8 is a perspective view of a packaging unit formed from the blank of FIG. 7.
Figure 11:
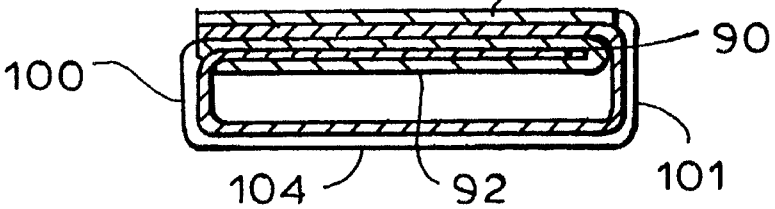
FIG. 11 is a cross-sectional view taken along line 11—11 of FIG. 10.

The package 110 shown in FIG. 10 is formed in the same manner as the packages shown in FIGS. 6 and 8. When the three ply header-spine is formed by folding leg 93 over leg 91 and then folding leg 96 over leg 93, a sleeve 111 (more rectangular than cylindrical) is established in situ when the legs 96 and 93 are glued along with the gluing of the header portions 95, 90, and 92. The cross-sectional configuration of this version of the invention is shown in FIG. 11.

It is to be understood that several preferred embodiments of the invention have been illustrated and described by way of examples only. These forms of the invention may be modified to suit particular packaging applications without departing from the scope of the invention as set forth hereinafter in the appended claims.

I claim:

1. A unit display package assembly for packaging articles for hanging from display hooks or for free-standing display comprising a foldable paperboard blank having a flat heat shrinkable film adhered thereto, (a) said paperboard blank being cut, scored, and folded to define a central header portion having contiguous first and second header wings articulated thereto;

(b) film support legs depending from each of said first and second header wings;

(c) lower edges of said central header and said wings and the inner side edges of said support legs defining an elongated U-shaped opening of predetermined width;

(d) said heat shrinkable film being adhered to said support legs and bridging said opening;

(e) a glue lap articulated to said first support leg and folded over one edge of said film to sandwich the film therebetween;

(f) said header wings being adapted to be folded into juxtaposition with said central header portion while said glue lap is folded into juxtaposition with said second support leg to form a three layer header having a depending multi-layer central spine and simultaneously forming a closed cylindrical heat shrinkable sleeve projecting outwardly from said central spine.

2. The unit display package assembly of claim 1 in which (a) said spine is of less width than said header giving said header and said spine a generally T-shaped configuration.

3. The unit display package assembly of claim 1 in which (a) said spine and said header are of the same width.

4. A unit display package assembly for packaging articles for hanging from display hooks or for free-standing display comprising a foldable paperboard blank having a flat heat shrinkable film adhered thereto, (a) said paperboard blank being cut and scored to define a first header panel having a first depending spine portion, a second header panel having a second depending spine portion, and a third header panel having a third depending spine portion, and a bridging bar panel interconnecting the second and third spine portions;

(b) a heat shrinkable film adhered to said second and third spine portions and said bridging bar panel; and (c) whereby said first, second, and third header panels may be juxtaposed and joined to establish a closed sleeve of shrinkable film for supporting a product therein and tightly against the spine portions depending from said header panels when said sleeve is heat shrunk.

5. The unit display package of claim 4, further characterized in that (a) a second bridging bar panel spaced from the first bridging bar panel is included in said paperboard blank; and (b) said film is adhered to said second bridging panel.

6. The unit display package of claim 4, further characterized in that:

(a) said bridging panel is scored to form three discrete portions adapted to assume a rectangular cross-section.

* * * * *